US005577489A

United States Patent [19]

Troncoso

[11] Patent Number: 5,577,489

[45] Date of Patent: Nov. 26, 1996

[54] ARROW SHAFT ALIGNING DEVICE AND ARROW REST INCORPORATING THE SAME

[76] Inventor: Vincent F. Troncoso, 14090-6100 Road, Montrose, Colo. 81401

[21] Appl. No.: 517,425

[22] Filed: Aug. 21, 1995

[51] Int. Cl.[6] ..... F41B 5/22

[52] U.S. Cl. ..... 124/44.5

[58] Field of Search ..... 124/24.1, 44.5

[56] References Cited

U.S. PATENT DOCUMENTS

| | | | |
|---|---|---|---|
| 4,598,688 | 7/1986 | Paul et al. | 124/44.5 |
| 4,664,093 | 5/1987 | Nunemaker | 124/24.1 |
| 4,967,722 | 11/1990 | Roberts | 124/44.5 |
| 5,062,407 | 11/1991 | Newbold | 124/44.5 |
| 5,429,107 | 7/1995 | Troncoso | 124/44.5 |

*Primary Examiner*—John A. Ricci

*Attorney, Agent, or Firm*—Donald E. Nist

[57] ABSTRACT

The arrow shaft aligning device and the arrow rest incorporating the same safely and accurately hold the shaft of an arrow before launching from the launcher arm of the rest. Parallel alignment of the arrow with the bow can more easily be confirmed using the aligning device. The device is a plate which defines in its upper surface an elongated track of at least about 1 inch in length which extends to the front end of the device. The rear portion of the device can be releasably connected, as by screws and the like, to the front end of an arrow rest launcher arm so as to extend forwardly thereof in alignment with the launcher arm. It is so connected in the rest of the present invention. The track has inwardly and downwardly curved and sloped sidewalls to accommodate arrow shafts of various diameters and to assure that when the shaft of an arrow is placed on the device and launcher arm it will stay in place until shot from an archery bow to which the rest can be attached.

4 Claims, 2 Drawing Sheets

FIG. 1
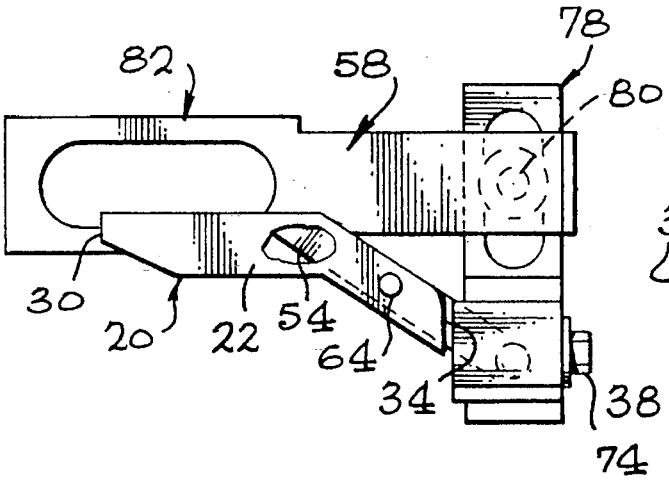
FIG. 3
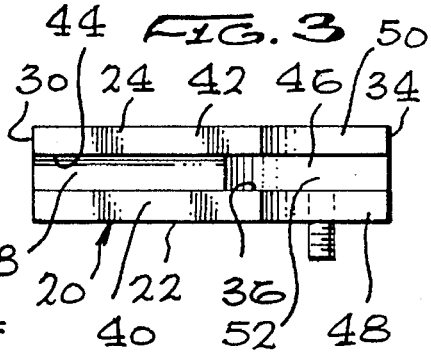
FIG. 2
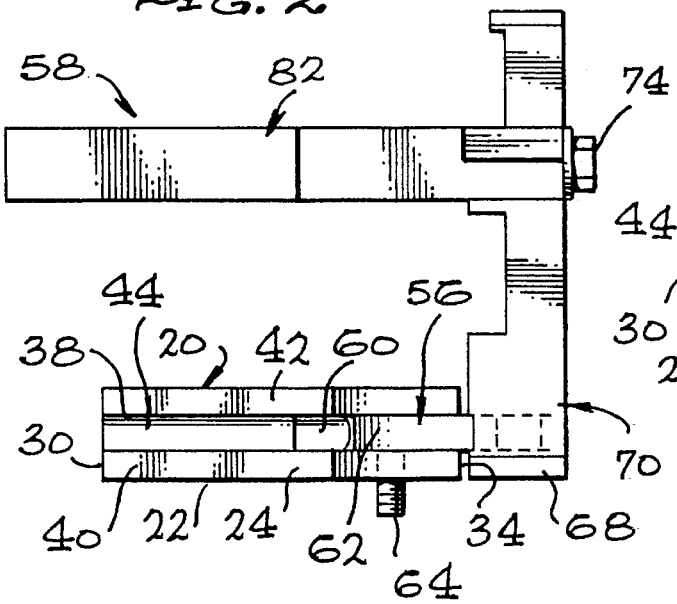
FIG. 4
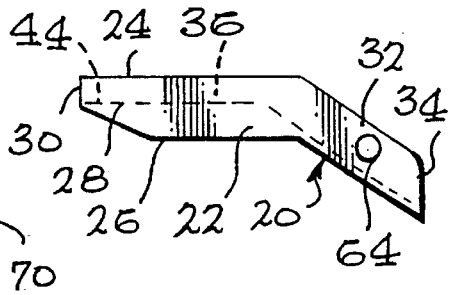
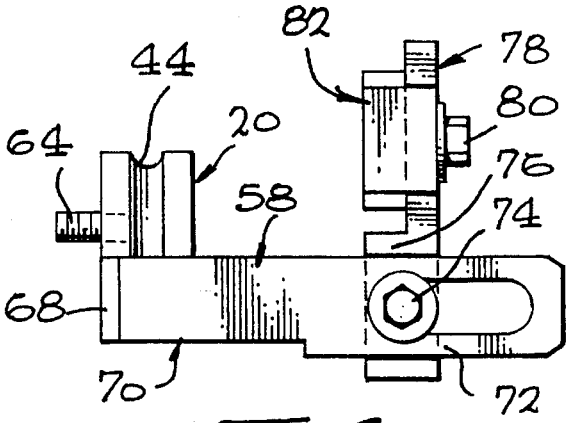
FIG. 6
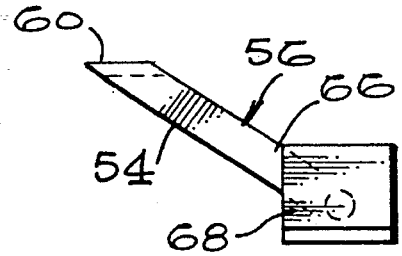
FIG. 5

FIG. 7
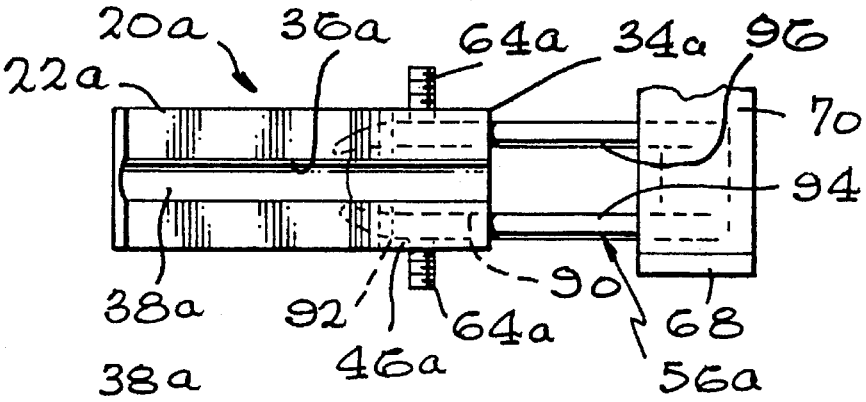
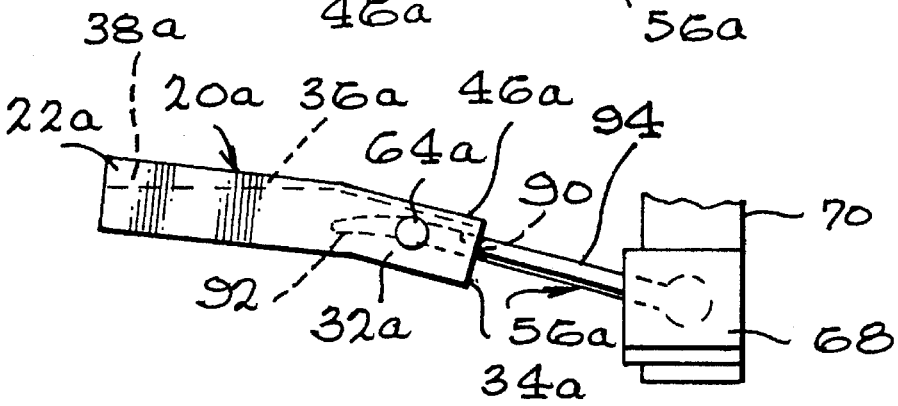
FIG. 8
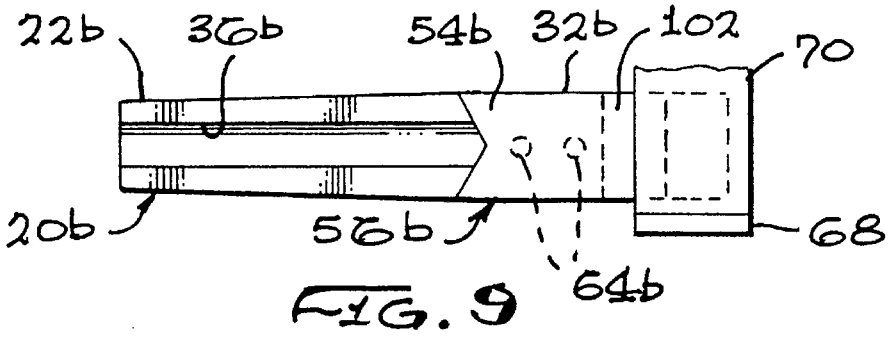
FIG. 9
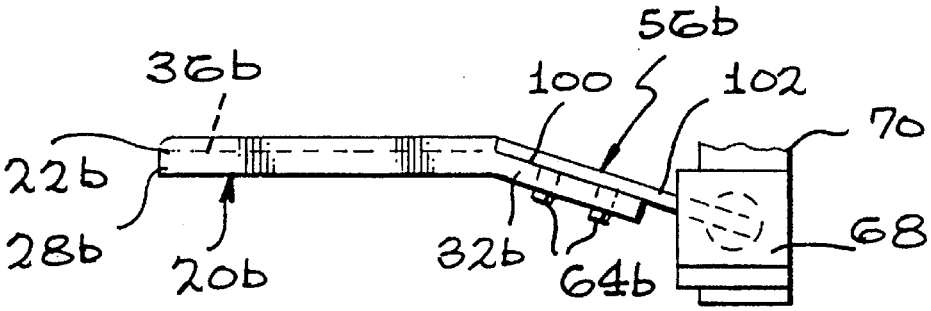
FIG. 10

ARROW SHAFT ALIGNING DEVICE AND ARROW REST INCORPORATING THE SAME

BACKGROUND OF THE INVENTION

1. Field of the Invintion

The present invention generally relates to sports devices and more particularly relates to a device capable of supporting and accurately aligning an arrow shaft and to an arrow rest containing the same.

2. Prior Art

Arrow rests of various types are utilized to hold the shafts of archery arrows before they are launched from an archery bow. Older forms of arrow rests mmerely consisted of relatively inflexible shelves connected to the sidewall of the riser section of the bow in the area defining the arrow window. Such arrow rests had many drawbacks, including the likelihood of interfering with the free flight of an arrow from the bow when shot.

Newer forms of arrow rests include means for adjustably positioning rest launcher arms in the arrow window for better arrow clearance. Such rests also have drawbacks, however. In most instances only the front tip of the launcher arm contacts the underside of the arrow shaft so that it is very easy to dislodge the arrow from the rest before shooting of the arrow takes place. There is also the problem of properly aligning the arrow so that it is on the front-rear axis of the bow in line with the bowstring and therefore will be shot straight forward out of the bow rather than at an angle. Such alignment is difficult to determine because of the limited contact of the launcher arm and the arrow shaft and the shortness of the launcher arm.

Accordingly, there is a need for an improved device which will assure proper support for the shaft of an arrow before it is shot to avoid roll-off of the arrow from an arrow rest, and which will enable the archer to more easily determine if the launcher arm of the rest is on the front-rear axis of the bow. Such device should be simple, inexpensive, durable and efficient and should be capable of being easily attached to and detached from the launcher arm of the arrow so as to form a part thereof.

SUMMARY OF THE INVENTION

All the foregoing needs are satisfied by the improved arrow shaft aligning device of the present invention and the improved arrow rest incorporating the same. The device comprises a plate or block having an elongated arrow shaft-receiving track in the upper surface thereof, which track extends to the front end of the plate.

The device also includes means, such as screws or the like, for releasably attaching the rear portion of the plate to the front end of a launcher arm so that the track extends in the proper direction and in line with the shaft-holding front end of the launcher arm.

In one embodiment, the track extends rearwardly to form a recess in which the front end of the launcher arm is held. In another embodiment, the rear end of the plate defines a recess into which the front end of the launcher arm is slideably received. In a further embodiment, the rear portion of the plate is configured so that the front portion of the launcher arm rests thereon for releasable connection thereto.

The track in the device has curved downwardly converging sidewalls capable of accommodating arrow shafts of various diameters without having them become easily dislodged from the track during drawing of the bowstring before shooting the arrow.

The track is sufficiently long, of the order of about 1 inch or more, so that it and the aligned arrow shaft form a visual sighting means to determine if the arrow rest is properly attached to the bow to cause the arrow shaft to be on the rear-front axis of the bow, that is, in line with the bowstring. In a preferred embodiment, a mounting block, rear crossbar, launcher arm and front-extending arrow shaft-aligning device form, in top plan view, a U-shaped configuration with the launcher arm and arrow shaft-aligning device parallel to the block and directly along the longitudinal axis of the bow. Any misalignment is easily noticed and can be corrected by shimming the mounting block, etc. This assures optimal performance of the archery bow.

The improved device of the present invention and the arrow rest incorporating the same can be made in a variety of sizes and configurations to suit individual needs. Further aspects of the present invention are set forth in the following detailed description and accompanying drawings.

DRAWINGS

FIG. 1 is a schematic side elevation of a first preferred embodiment of the improved arrow shaft-aligning device of the present invention and the arrow rest incorporating the same;

FIG. 2 is a schematic top plan view of the device and rest of FIG. 1;

FIG. 3 is a schematic top plan view of the device of FIG. 1;

FIG. 4 is a schematic side elevation of the device of FIG. 1;

FIG. 5 is a schematic side elevation of the launcher arm of the arrow rest of FIG. 1;

FIG. 6 is a schematic rear elevation of the device and rest of FIG. 1;

FIG. 7 is a schematic top plan view of a second preferred embodiment of the device of the present invention, shown disposed around a two-pronged launcher arm assembly;

FIG. 8 is a schematic side elevation of the device of FIG. 7;

FIG. 9 is a schematic top plan view of a third preferred embodiment of the improved device of the present invention, shown connected to a blade-type flexible launcher arm; and, FIG. 10 is a schematic side elevation of the device of FIG. 9.

DETAILED DESCRIPTION

FIGS. 1–6.

Now referring more particularly to FIGS. 1–6 of the drawings, a first preferred embodiment of the improved arrow shaft aligning device of the present invention and the arrow rest incorporating the same is schematically illustrated therein.

Thus, device 20 is shown particularly in FIGS. 3 and 4 and comprises an elongated body, block or plate 22 having an upper surface 24, an opposite lower surface 26, a front portion 28 terminating in a front end 30, and a rear portion 32 terminating in a rear end 34. Plate 22 preferably is generally rectangular in top plan view, with front portion 28 being positioned generally horizontally and rear portion 32 sloping downwardly to rear end 34.

Upper surface 24 defines a recessed track 36 having a front portion 38 with downwardly and inwardly sloping sides 40 and 42 and a horizontally extending curved bottom 44 in front portion 20 adapted to cradle the shaft of an archery arrow (not shown). Track 36 terminates forwardly at front end 30.

The rear portion 46 of track 36 extends rearwardly to rear end 34 of body 22, has vertical sides 48 and 50 and a flat bottom 52 and is adapted to receive the front portion 54 of a launcher arm 56 of arrow rest 58 so that the curved front tip 60 of arm 56 mates therewith and forms a rearwardly aligned extension 62 of the front portion 38 of track 36, as shown in FIG. 2. Body 22 is releasably secured to front portion 54 of launcher arm 56, as by a transverse screw or threaded bolt 64.

As can be seen in FIGS. 1, 2 and 5, launcher arm 56 extends upwardly and forwardly and has horizontal front portion 54 and an opposite rear end 66. End 66 is rotatably secured to the free end 68 of crossbar 70 and extends forwardly thereof. Preferably, arm 56 is spring biased into the position shown in FIG. 5. Crossbar 70 extends transversely of arrow rest 58 at the rear end thereof and is slideably adjustably secured at end 72 thereof, as by a screw or threaded bolt 74 passing forwardly therethrough and into the rear end 76 of a vertical connector block 78.

Block 78 is in turn slideably adjustably secured, as by a screw 80 or the like, to a forwardly and rearwardly aligned mounting block 82 adapted to be secured to a sidewall of an archery bow in the riser section thereof adjacent an arrow window in the riser section (not shown).

When so attached, block 82 and block 78 extend rearwardly of the riser section and crossbar 70 extends transversely therebehind. Launcher arm 56 extends forwardly and upwardly in the arrow window (not shown). The vertical position of arm 56 is adjustable, as by block 78, and the transverse spacing of arm 56 from the adjacent side of the riser section of the archery bow is adjustable, as by crossbar 70. Thus, rest 58 is fully adjustable.

With body 22 in place on arm 56, rest 58 has the improved capability of fully supporting an arrow shaft (not shown) over a substantial length thereof. Alignment of such shaft with the front-rear axis of the bow, that is, with the bowstring and the direction of travel of the bowstring when released during shooting is important. If the arrow shaft is misaligned, since body 22 and arm 56 are parallel with block 82, block 82 can be shimmed to correct the misalignment. In plan view, arrow rest has a U-shaped configuration.

The length of body 22 is usally about 2 inches, with track 36 usally being slightly more than 1 inch in length, so that the alignment of the arrow shaft is facilitated thereby.

Rest 58 can be fabricated in any suitable size and shape and of any suitable materials, but preferably is of metal, such as aircraft aluminum alloy or the like. It has substantial advantages over the prior art, as set forth above.

FIGS. 7 and 8.

A second preferred embodiment of the improved arrow shaft aligning device of the present invention is schematically shown in FIGS. 7 and 8. Thus, device **20*a* is shown. Components similar to those of device 20** bear the same numerals but are succeeded by the letter "a".

Device **20*a* is substantially identical to device 20**, except as follows:

a) Device **20*a* has a recess 90 in the rear end 34*a* thereof and portion 32*a* is otherwise closed. Recess 90 is dimensioned to receive the front portions 92 of two spaced curved prongs 94 and 96 comprising launcher arm 56*a***;

b) Track **36*a* has a front generally horizontal portion 38*a* and a contiguous downwardly directed rear portion 46*a*; and, c) A pair of screws 64*a* extend transversly from opposite sides of rear portion 32*a* of body 22*a* and into recess 90 to releasably lock prongs 94 and 96** in place.

Device **20*a* is adapted for use with the two-pronged launcher arm 56*a* and functions similarly to device 20**.

FIGS. 9 and 10.

A third preferred embodiment of the improved arrow shaft aligning device of the present invention is schematically depicted in FIGS. 9 and 10. Thus, device **20*b* is shown. Components thereof similar to those of device 20** bear the same numerals but are succeeded by the letter "b".

Device **20*b* is substantially identical to device 20**, except as follows:

a) Body **22*b* is a flat plate bearing track 36*b* in the front portion 28*b* thereof and having an upper recess 100 in the rear portion 32*b* of body 22*b* releasably receiving on its upper surface the front V-notched portion 54*b* of the single flat blade 102 comprising launcher arm 56*b*; and, b) Rear portion 32*b* of body 22*b* is releasably secured to front portion 54*b* by a spaced pair of screws 64*b* extending up through portion 32*b* and into portion 54*b***.

Device **20*b* is adapted for use specifically with the flexible resilient single blade-containing launcher arm 56*b***.

It will be understood that launcher arm **56*a* and 56*b* can be substituted for launcher arm 56 in crossbar 70 of arrow rest 58** and will perform similarly. Further modifications, changes, alterations and additions can be made in the improved arrow shaft aligning device of the present invention, its components and parameters and in the improved arrow rest incorporating the same. All such modifications, changes, alterations and additions as are within the scope of the appended claims form part of the present invention.

What is claimed is:

1. A improved arrow shaft aligning device for an arrow rest launcher arm, said device comprising, in combination:

a) an elongated plate having an upper surface and an opposite lower surface, a front portion and an opposite rear portion, said upper surface defining a longitudinally extending arrow shaft-receiving and aligning track extending to the front end of said plate, said plate being adapted to releasably connect to an arrow rest launcher arm, said rear portion of said plate containing a recess in the upper surface thereof aligned with said track for releasably receiving the front portion of a launcher arm; and, b) connector means attached to said rear portion of said plate for connecting said plate to said launcher arm.

2. The improved device of claim 1 wherein said plate comprises metal, wherein said track has inwardly and downwardly curved and sloped sides to accommodate arrow shafts of various diameters and wherein said track is at least about one inch in length with parallel sides.

3. An improved arrow shaft aligning device for an arrow rest launcher arm, said device comprising, in combination:

a) an elongated plate having an upper surface and an opposite lower surface, a front portion and an opposite rear portion, said upper surface defining a longitudinally extending arrow shaft-receiving and aligning track extending to the front end of said plate, said plate being adapted to releasably connect to an arrow rest launcher arm, said rear portion of said plate defining a recess in the rear end thereof for slideably receiving a launcher arm assembly; and, b) connector means attached to said rear portion of said plate for connecting said plate to an arrow rest launcher arm.

4. An improved arrow shaft aligning device for an arrow rest launcher arm, said device comprising, in combination:

a) an elongated plate having an upper surface and an opposite lower surface, a front portion and an opposite rear portion, said upper surface defining a longitudinally extending arrow shaft-receiving and aligning track extending to the front end of said plate, said plate being adapted to releasably connect to an arrow rest launcher arm, said rear portion of said plate having a blade which extends below and supports a launcher arm when said launcher arm is joined to said plate; and, b) connector means attached to said rear portion of said plate for connecting said plate to an arrow rest launcher arm.

* * * * *